US006505615B2

(12) United States Patent
Pietschner

(10) Patent No.: US 6,505,615 B2
(45) Date of Patent: Jan. 14, 2003

(54) DEVICE TO DEOIL THE CRANKCASE VENTILATION GASES OF AN INTERNAL COMBUSTION ENGINE

(75) Inventor: Sieghard Pietschner, Greven (DE)

(73) Assignee: Ing. Walter Hengst GmbH & Co. KG, Muenster (DE)

( * ) Notice: Subject to any disclaimer, the term of this patent is extended or adjusted under 35 U.S.C. 154(b) by 0 days.

(21) Appl. No.: 10/059,908

(22) Filed: Jan. 29, 2002

(65) Prior Publication Data

US 2002/0100465 A1 Aug. 1, 2002

Related U.S. Application Data

(63) Continuation of application No. PCT/EP01/06159, filed on May 30, 2001.

(51) Int. Cl.[7] ..... F02M 25/06
(52) U.S. Cl. ..... 123/572
(58) Field of Search ..... 123/572, 573, 123/574

(56) References Cited

U.S. PATENT DOCUMENTS

| | | | | |
|---|---|---|---|---|
| 4,169,432 A | | 10/1979 | White | |
| 5,460,147 A | * | 10/1995 | Bohl | 123/572 |
| 5,564,401 A | | 10/1996 | Dickson | |
| 5,586,541 A | | 12/1996 | Tsai | |
| 5,669,366 A | * | 9/1997 | Beach et al. | 123/572 |
| 6,082,343 A | * | 7/2000 | Oishi et al. | 123/572 |
| 6,123,061 A | * | 9/2000 | Baker et al. | 123/572 |
| 6,247,463 B1 | * | 6/2001 | Fedorowicz et al. | 123/572 |
| 6,354,283 B1 | * | 3/2002 | Hawkins et al. | 123/572 |

FOREIGN PATENT DOCUMENTS

| | | |
|---|---|---|
| DE | 42 14 324 A1 | 11/1993 |
| EP | 0 713 720 | 5/1996 |
| EP | 0 730 086 | 9/1996 |
| EP | 0 810 351 | 12/1997 |

* cited by examiner

*Primary Examiner*—Marguerite McMahon
(74) *Attorney, Agent, or Firm*—Sonnenschein Nath & Rosenthal

(57) ABSTRACT

A device to deoil crankcase ventilation gases of an internal combustion engine with at least one oil mist separator is provided which has a gas inlet connected to a first pressure area and is directly or indirectly connected to the crankcase of the engine. The separator also has a gas outlet connected to a second pressure area and is directly or indirectly connected to the air intake section of the engine and an oil outlet connected to the oil sump of the engine. The separator further has a bypass channel, which has a gas inlet connected to the first pressure area and a gas outlet connected to the second pressure area as well as at least one device which, depending on the pressure difference between the two pressure areas, opens or closes the bypass channel continuous or gradually to allow the crankcase ventilation gases to flow through. When the bypass channel is open, a partial volumetric flow of the crankcase ventilation gas flows past the oil mist separator through the bypass channel into the second pressure area, wherein the bypass channel and the device to open and close the bypass channel are designed so that, when the bypass channel is opened, deoiling is brought about by flow diversion or impact separation in the bypass channel.

20 Claims, 6 Drawing Sheets

DEVICE TO DEOIL THE CRANKCASE VENTILATION GASES OF AN INTERNAL COMBUSTION ENGINE

This application is a continuation of International Application PCT/EP01/06159, filed May 30, 2001. The present and foregoing application claim priority to German Application No. 200 09 605.2, filed May 30, 2000. All of the foregoing applications are incorporated herein by reference to the extent permitted by law.

BACKGROUND OF THE INVENTION

The invention concerns a device to deoil the crankcase ventilation gases of an internal combustion engine with at least one oil mist separator which has a gas inlet that is connected to the crankcase, a gas outlet that is connected to the air intake section and an oil outlet that is connected to the oil sump of the internal combustion engine.

During the operation of an internal combustion engine so-called blow-by-gases get inside the crankcase and have to be drawn off since, otherwise, there would be an unwanted increase of internal pressure in the crankcase. To achieve this, the blow-by-gases are redirected to the air intake section as crankcase ventilation gases via an air vent channel. In order to deoil the crankcase ventilation gas the gases are directed in a known way through an oil mist separator, whose gas inlet is connected directly or indirectly via a crankcase low-pressure control valve to the crankcase and whose gas outlet is connected directly or indirectly via the crankcase low-pressure control valve to the air intake section. In this way, the oil mist separator generates a pressure difference ($\Delta p = p_1 - p_2$) because of its flow resistance.

In the following description, the pressure area on the gas inlet side will be called the $1^{st}$ pressure area (p1) and the pressure area on the gas outlet side will be called the $2^{nd}$ pressure area (p2).

The differential pressure drop over the oil mist separator directly causes a rise in pressure in the crankcase. The degree of separation of the oil mist separator also depends on the pressure difference.

Preferably, cyclones or so-called coalescence separators in the form of a knitted separator or a wrap-round separator are used as oil mist separators. A cyclone oil mist separator, for example, is known from DE 14 324 C2. A deoiling device with a coalescence separator is described in DE 197 29 439 A1.

The problem with the use of an oil mist separator however is that its flow resistance and therefore the pressure difference generated by the oil mist separator is not constant but changes depending on the type of oil mist separator that is used in association with the specific parameters. In the case of a cyclone, the flow resistance and hence the generated pressure difference depends on the volumetric flow of the blow-by gases. This in turn depends on the load state and the rotational speed of the internal combustion engine, which can change in the short term. The volumetric flow of the blow-by gases is also dependent on the wear of the internal combustion engine, which increases over time. In the case of a knitted separator or a wrap-round separator the flow resistance depends on the degree of contamination, which can also increase over time. To remedy this, the known state of the art recommends a bypass channel controlled by a valve that adjusts to the differential pressure. The disadvantage is that the oil mist does not precipitate out of the gas that passes through the bypass channel.

Increases in differential pressure in the oil mist separator that go beyond a specific level cause an unacceptable pressure increase in the crankcase, which causes damage to the internal combustion engine especially when its effect extends over a long time, or it occurs frequently.

SUMMARY OF THE INVENTION

The task of the invention therefore is to develop a device to deoil the crankcase ventilation gases, which will cause the oil mist to precipitate and prevent the unacceptable pressure increase in the crankcase under all operating conditions.

This task is achieved through the distinguishing features of claim 1. The associated subclaims contain advantageous working designs and the further development of the invention.

According to the invention, the device, in respect of its flow-through rate, uses a controllable bypass channel, which is located as a bypass in parallel to the oil mist separator in the crankcase air-bleed duct. To this end, the bypass channel has a gas inlet that is connected directly or indirectly to the crankcase ($1^{st}$ pressure area) and a gas outlet that is connected directly or indirectly to the air intake section ($2^{nd}$ pressure area). In order to control the gas flow-through rate, the invention provides for a device that, depending on the differential pressure ($\Delta p = p_1 - p_2$) between the two pressure areas, opens and closes the bypass channel to enable the crankcase ventilation gases to flow through constantly or gradually and also causes the oil to separate off when the bypass channel is open. The bypass channel, together with its control device, has been developed so that deoiling will also occur in the bypass channel as a result of flow diversion and impact separation or as a result of impaction. The separation behaviour of the entire device (oil mist separator plus controllable bypass channel) ensures that the level of separation is sufficiently high even when the bypass is open. To carry away the oil that has separated off in the bypass channel, the bypass channel is connected to the oil sump for example via an oil outlet.

If the differential pressure in the oil mist separator exceeds a specific value, the device releases the bypass channel for the crankcase ventilation gas to flow through so that a partial volumetric flow of the crankcase ventilation gas flows past the oil mist separator through the bypass channel into the $2^{nd}$ pressure area (air intake section). In this way, a damaging rise in pressure in the crankcase and an insufficient oil mist separation can be avoided.

In practice, the oil mist separator is designed so that it exhibits a specific degree of separation for a specific volumetric flow, and a specific differential pressure drop is also implicit. When determining the operating point, care must be taken to ensure that the differential pressure plus, if necessary, a certain tolerance zone lies below the critical limit for the crankcase pressure.

If the volumetric flows of the blow-by gas become permanently higher over time as a result of wear, even if the operating conditions (load state, rotational speed) of the internal combustion engine remain the same, in the case of a cyclone oil mist separator, this would cause a drastic rise in differential pressure, which in turn would result in a damaging rise in pressure in the crankcase. This rise in differential pressure can only be counteracted by the controllable bypass. The device that opens and closes the bypass channel is designed so that the opening pressure is equal to the differential pressure plus, if necessary, an extra tolerance that is critical for the crankcase.

According to the invention, the controllable bypass works in the same way with a knitted separator or a wrap-round separator, which, if the volumetric flow remained the same, would generate a substantially increased differential pressure in the entire device as a result of contamination over time. With a knitted separator or a wrap-round separator in particular, the invention provides for a sensor that detects whether the bypass channel is open or not. If the bypass channel is open (valve in the open position), an optical or acoustic warning signal is generated for the operator of the internal combustion engine. This signal is an indication that the knitted separator or wrap-round separator has reached a specific degree of contamination. The operator can then react accordingly and change the knitted separator or wrap-round separator.

The effect of the controllable bypass channel to reduce the differential pressure does not of course arise only with differential pressure rises that occur after a certain time as a result of the wear of the internal combustion engine or contamination of the oil mist separator, but also with differential pressure rises that occur in the short term.

BRIEF DESCRIPTION OF THE DRAWING

The invention will be explained in more detail below with the help of the accompanying drawings.

DETAILED DESCRIPTION OF THE PREFERRED EMBODIMENT

Figure 1:
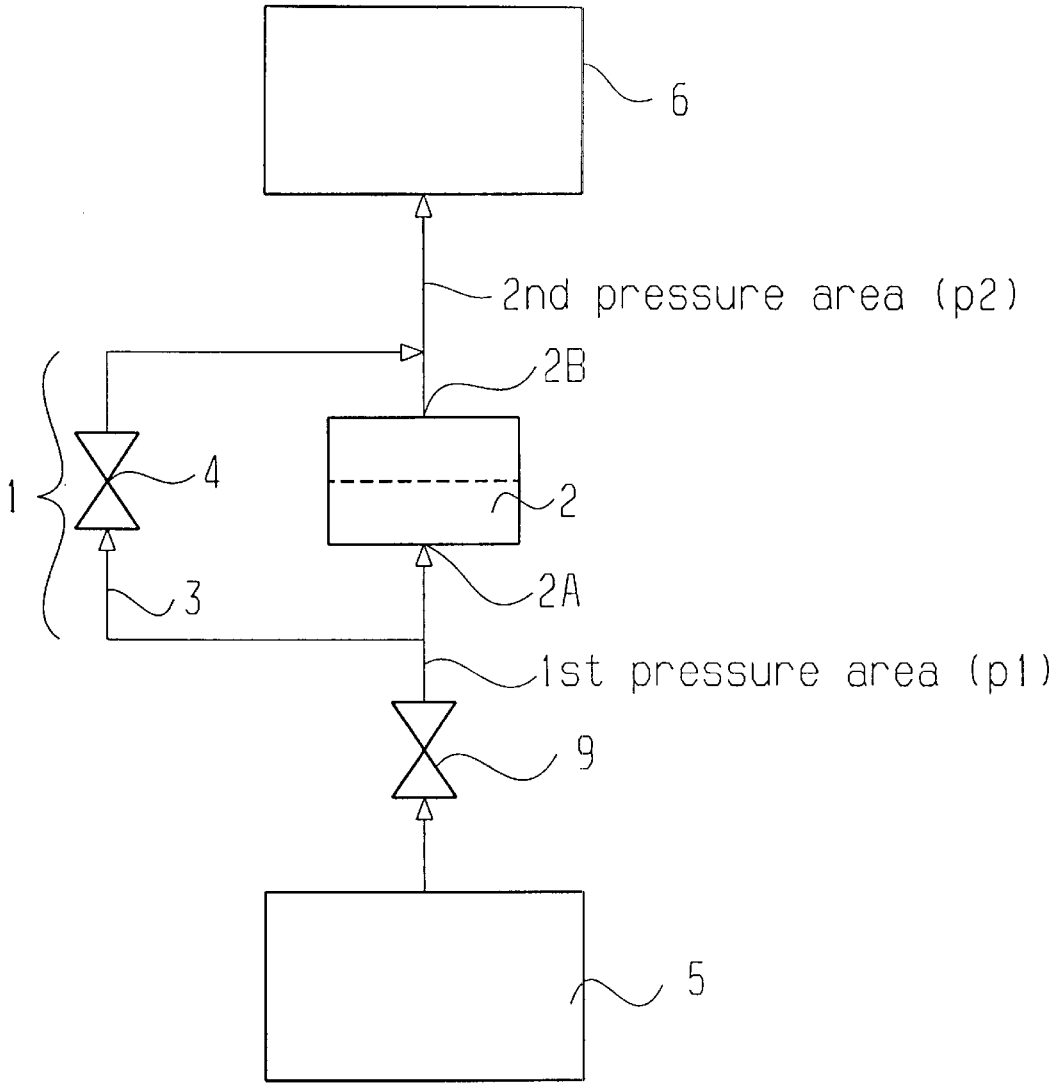
FIG. 1 is a diagrammatic representation of the layout of the device resulting from the invention in the air-bleed duct, in which a crankcase low-pressure control valve is arranged in front of the device.

FIG. 1 shows a diagrammatic layout of the device resulting from the invention (1) in the air-bleed duct. The device (1), comprising an oil mist separator (2) and a controllable bypass channel (3) is located between the crankcase (5) that is to be ventilated and the air intake section (6). The low pressure in the air intake section (6) can rise sharply under specific operating conditions of the internal combustion machine. In order to avoid too great a pressure, a so-called crankcase low-pressure control valve (9) is located in the air-bleed duct, which here is arranged in front of the deoiling device (1). The gas inlets (2A, 3A) of the oil mist separator (2) and of the bypass channel (3) are therefore indirectly connected to the pressure area of the crankcase (5) via the crankcase low-pressure control valve (9). The pressure on the gas inlet side is referred to as the $1^{st}$ pressure area. The gas outlets (2B, 3B) of the oil mist separator (2) and of the bypass channel (3) are here directly connected to the air intake section (6), which is referred to as the $2^{nd}$ pressure area.

Figure 2:
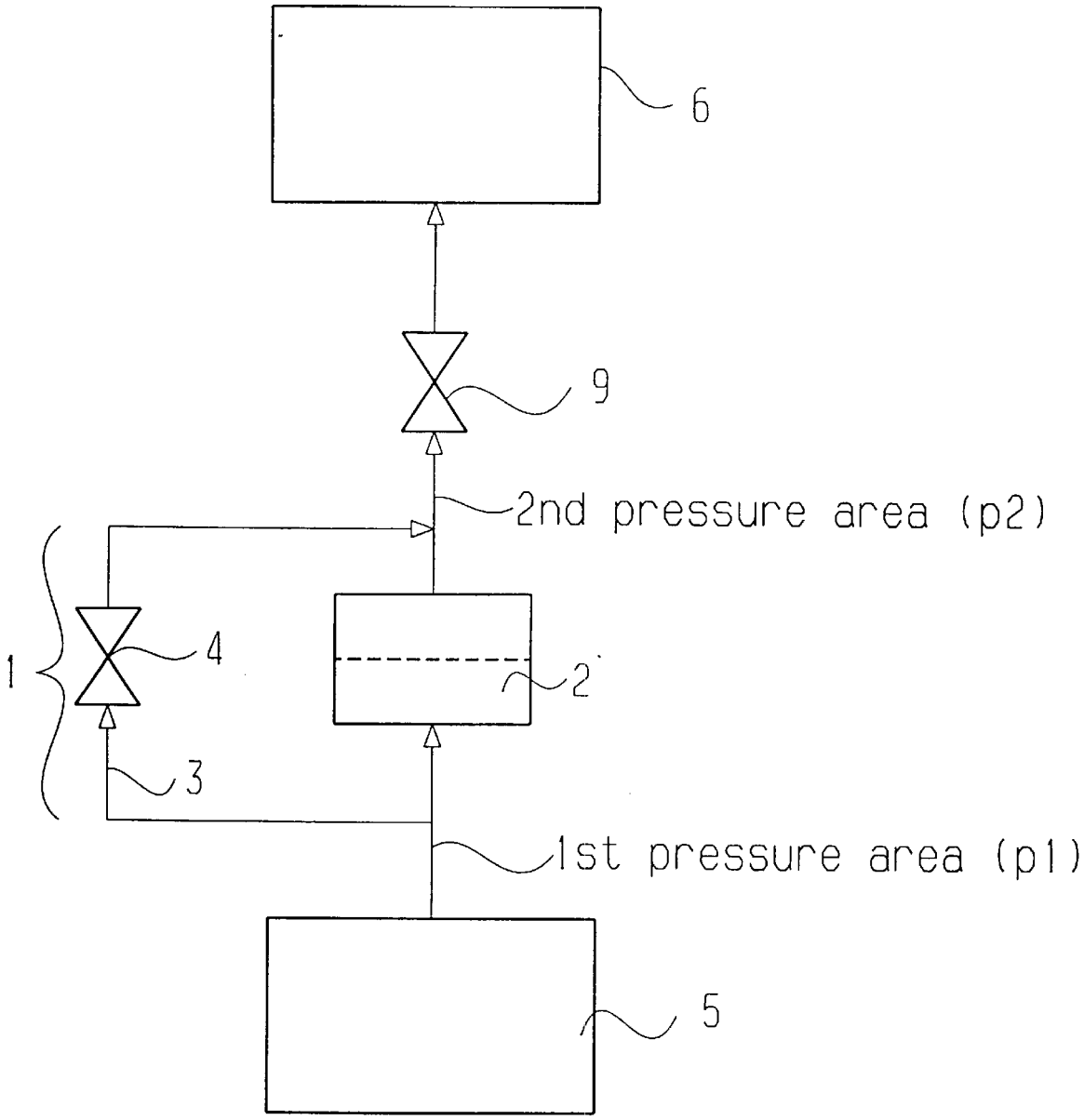
FIG. 2 is a diagrammatic representation of the layout of the device resulting from the invention in the air-bleed duct, in which the crankcase low-pressure control valve is arranged behind the device.

In FIG. 2, the crankcase low-pressure control valve (9) is arranged behind the deoiling device (1).

Figure 3:
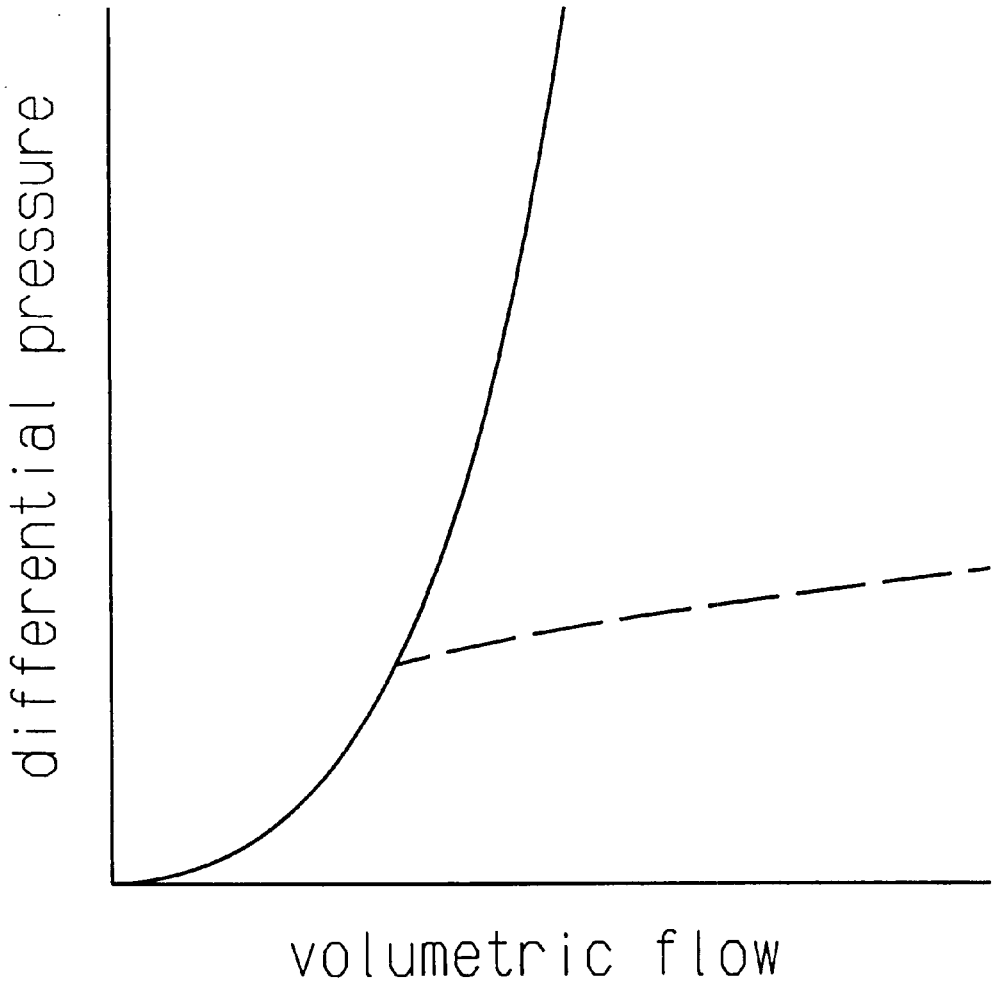
FIG. 3 graphically illustrates differential pressure/volumetric flow characteristics.

FIG. 3 shows the differential pressure/volumetric flow characteristics for a cyclone separator device. The continuous line refers to a cyclone without the controllable bypass channel. The broken line refers to a design of the device consisting of a cyclone and a controllable bypass channel. As one can see, the differential pressure in the case of a cyclone oil mist separator rises dramatically with a rising volumetric flow. Especially when the internal combustion engine is worn, the volumetric flows can permanently be so big that the associated rise in differential pressure is unacceptable. The device resulting from the invention counteracts this increase in pressure. As one can see from the diagram, with a specific volumetric flow, which causes a critical drop in pressure in the cyclone, the bypass channel opens automatically so that any further rise in differential pressure with increasing volumetric flows is much flatter.

Figure 4:
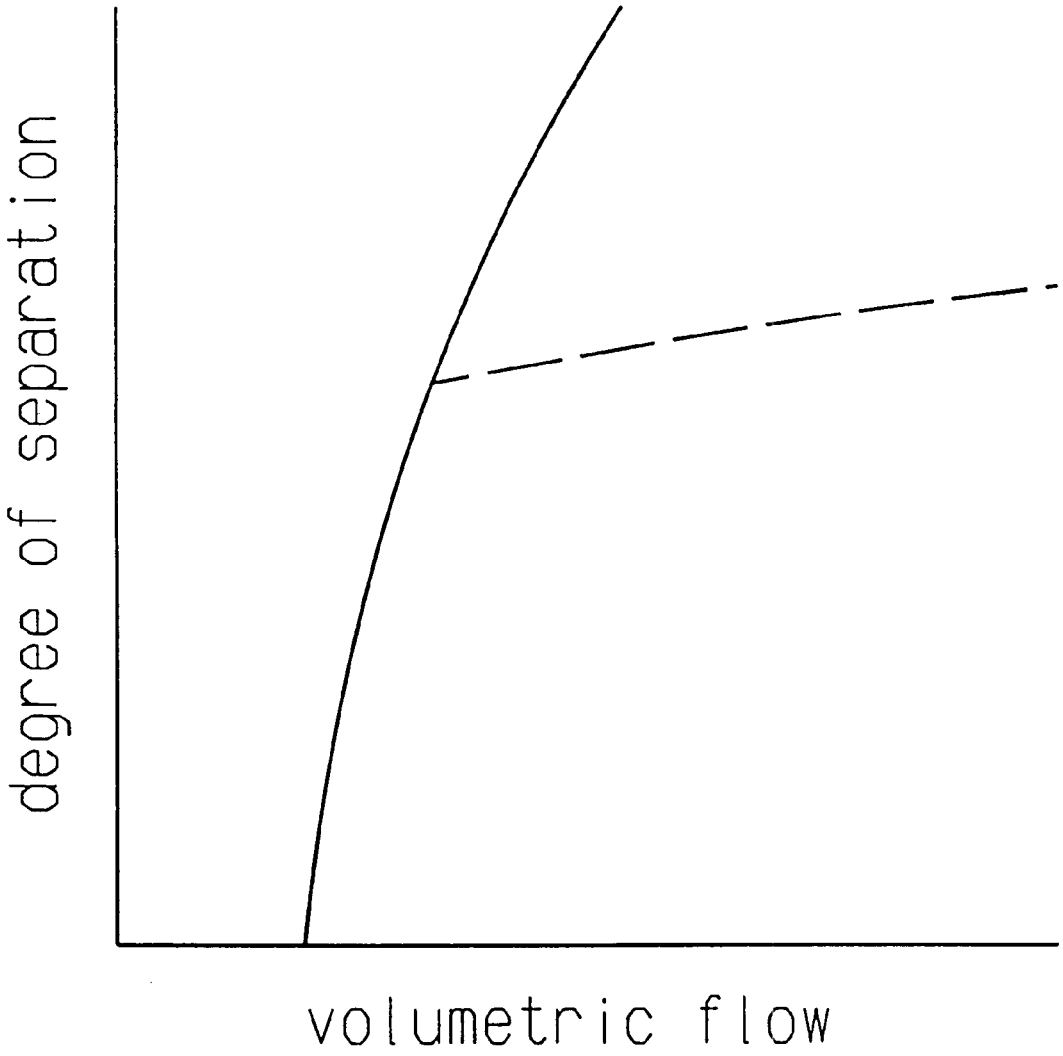
FIG. 4 graphically illustrates degree of separation/volumetric flow characteristics.

FIG. 4 shows the degree of separation/volumetric flow characteristics for a cyclone separator device. The continuous line refers to a cyclone without the controllable bypass channel. The broken line refers to a design of the device consisting of a cyclone and a controllable bypass channel. As one can see, there is still a good degree of separation even when the bypass channel is open—even if this is less than with a cyclone oil mist separator without a bypass channel.

Figure 6:
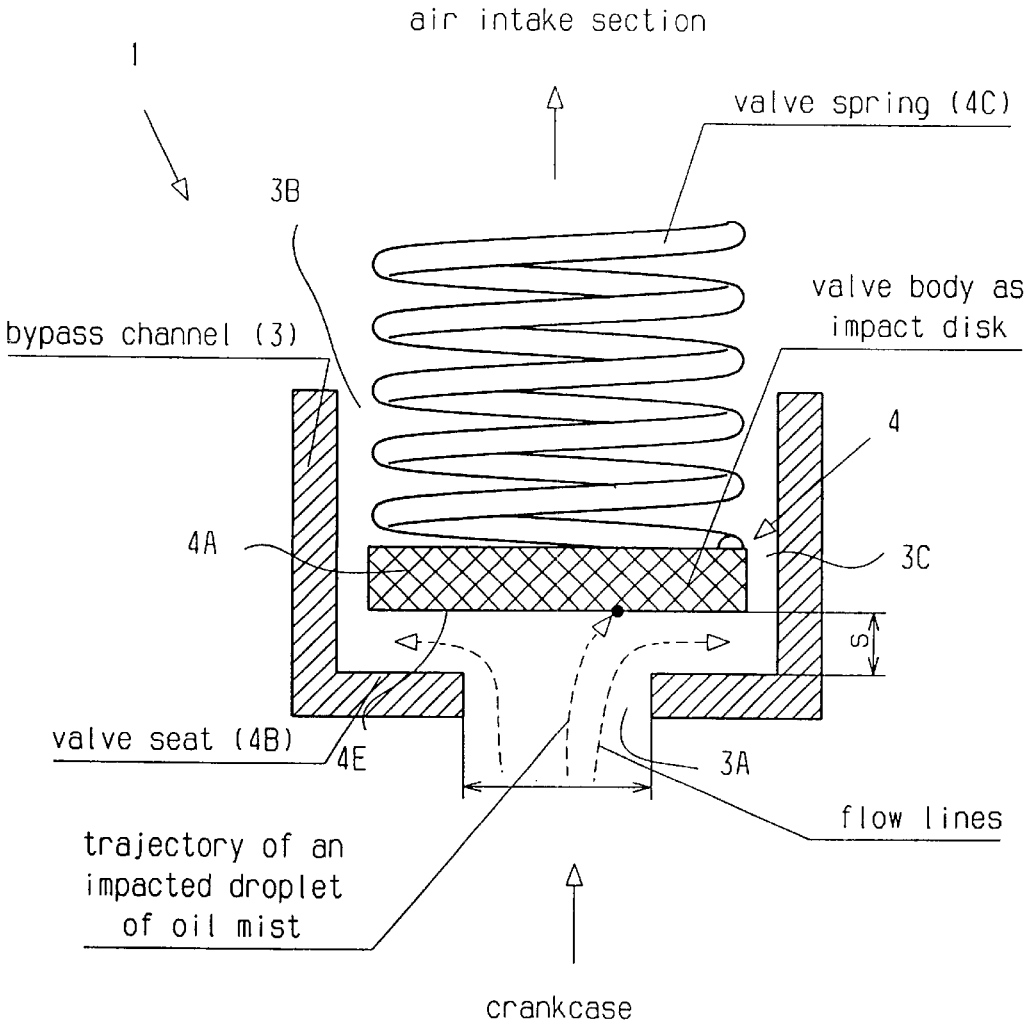
FIG. 6 is an enlarged representation of the bypass channel in the area of the valve body to elucidate the impact separation resulting from a flow diversion.

The relatively good degree of separation even when the bypass channel is open is due to the special organization of the bypass channel along with its control device. These are designed so that deoiling will occur as a result of flow diversion and impact separation or as a result of impaction. FIG. 6 shows an enlarged representation of the bypass channel in the area of the valve body so as to elucidate the oil mist separation according to the impaction principle. The spring-discharged valve body works as an impact disc of a dynamically adjusting impactor, whose flow gap (8) can be adjusted via the valve spring depending on the differential pressure.

The device resulting from the invention exhibits a high degree of separation in the design of the oil mist separator, while, with high volumetric flows, excess pressure in the crankcase can be avoided and an adequately high degree of separation can then also be achieved.

Figure 5:
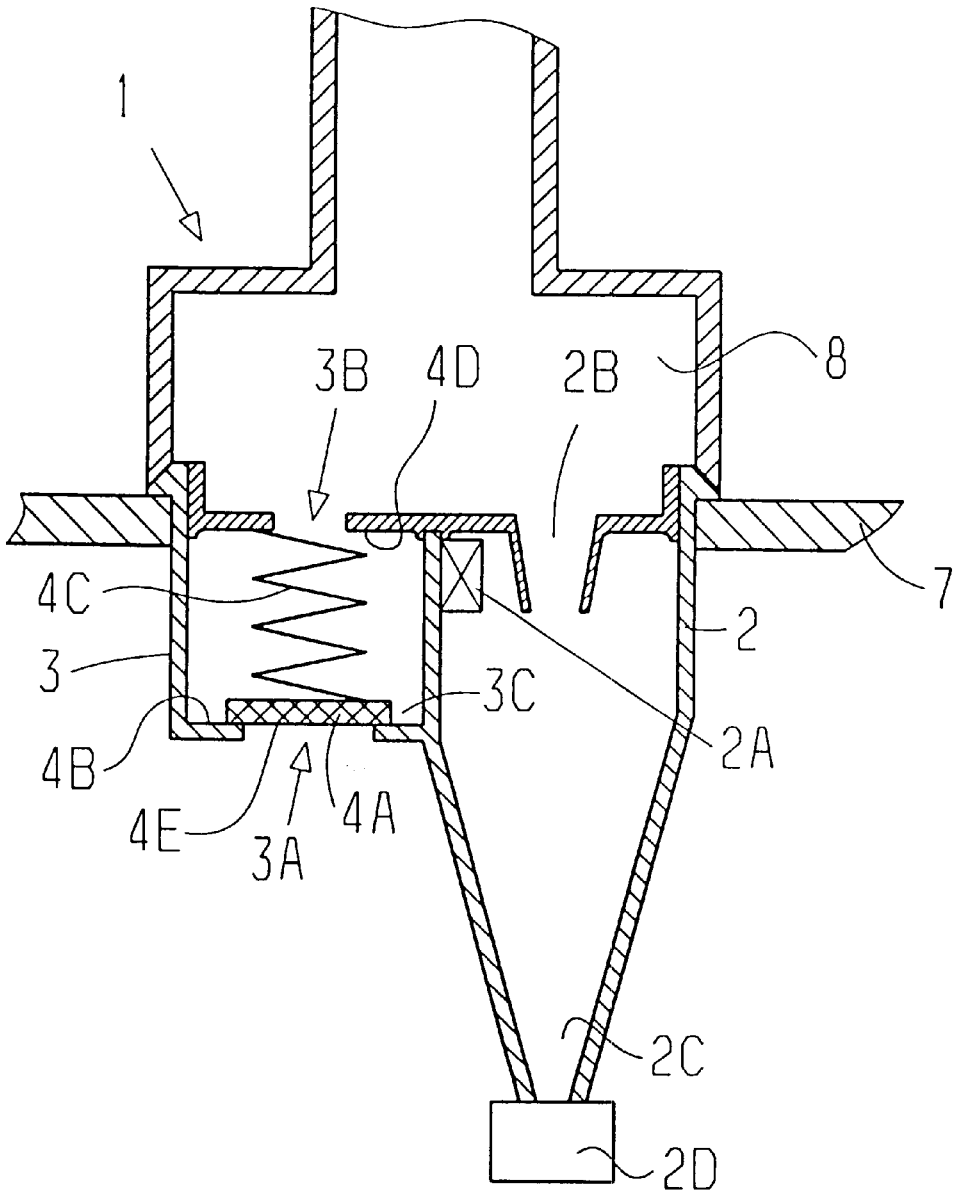
FIG. 5 is a cross-section of the device incorporating principles of the invention.

FIG. 5 shows a cross-section through an embodiment of the invention. The oil mist separator is designed as a cyclone (2) which is arranged in one piece with the bypass channel (3). Preferably, the cyclone (2) and the bypass channel (3) are formed in one piece using the injection molding method, which enables the device resulting from the invention to be manufactured cheaply. Preferably, the oil mist separator (2) and the bypass channel (3), which here are formed as an integral assembly, are placed in a reception case (7), which here is only hinted at. The reception case (7) is connected to the $1^{st}$ pressure area so that the gas inlets (2A, 3A) of the cyclone (2) and the bypass channel (3) are charged inside the reception area (7) with the pressure $p_1$. The gas outlets (2B, 3B) from the cyclone (2) and the bypass channel (3) are insulated against the pressure area inside the reception case, out of which they are led into the $2^{nd}$ pressure area (to the air intake section). Preferably, the outlets (2B, 3B) of the cyclone (2) and the bypass channel (3) are led to an insulated intermediate space (8) that is connected to the $2^{nd}$ pressure area. Because of the integral assembly (cyclone+bypass channel) and the fact that it is installed in a pressure-tight reception case (7), there is no need for separate, otherwise doubly executed connecting lines from the crankcase to the gas inlets and from the gas inlets to the air intake section.

The device (4) for opening and closing the bypass channel (3) depending on the differential pressure is a valve body (4A)—here a valve plate—charged by a pressure spring (4C), which is located in the bypass channel (3). Below a pre-specified opening pressure difference, the valve body (4A) is pressed into a closed position by the pressure spring (4C) against a valve seat (4B), which is located in the bypass channel. Above the pre-specified opening pressure difference the valve body (4A) is raised by the valve seat (4B) against the pressure spring (4C) with the release of a flow gap (S). The opening pressure difference results from the spring constants and the surface of the valve body (4A) that is flowed along. In order to counteract the production tolerances of the pressure spring (4C), the pressure spring (4C) is mounted in the bypass channel (3) with a targeted preload that is adapted to the opening pressure difference. For this purpose, the overall length of the pressure spring (4C) can be adjusted in the differential pressure-less state. This can be achieved for example by supporting the end of the pressure spring that is turned away from the valve body on a support element (4D) in the bypass channel (3), whose axial distance from the valve seat (4B) can be adjusted (not shown).

Instead of a valve body with a pressure spring, a valve body can also be used which is pressed into a closed position against the valve seat by gravity below a specific opening pressure difference. Above the opening pressure difference, the valve body is raised from the valve seat with the release of the flow gap.

To limit the flow gap (S) to a maximally acceptable level, a lift limiter stop can be provided (not shown).

As an alternative device for opening and closing the bypass channel a hinged throttle valve located in the bypass channel or a leaf valve that closes an opening under preload can be used (neither of which are shown). These also cause deoiling through impaction.

Geodetically under the device (1) shown in FIG. 5 is the oil sump. The oil that is separated by the cyclone (2) reaches the oil sump via an outlet valve (2D) located in the oil outlet (2C). The oil that is separated by the bypass channel (3) can be discharged via the gas inlet (3A) and flow back or drop into the oil sump directly or via an intermediate tank (not shown).

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A device to deoil crankcase ventilation gases of an internal combustion engine with at least one oil mist separator, which has:

a gas inlet connected to a first pressure area and connected to a crankcase of the engine;

a gas outlet connected to a second pressure area and connected to an air intake section of the engine;

an oil outlet connected to an oil sump of the internal combustion engine;

wherein;

a bypass channel, which has a gas inlet connected to the first pressure area and a gas outlet connected to the second pressure area and with no filter element therein;

at least one device which, depending on a pressure difference between the two pressure areas, opens or closes the bypass channel one of continuously and gradually, to allow the crankcase ventilation gases to flow through;

when the bypass channel is open, a partial volumetric flow of the crankcase ventilation gas flows past the oil mist separator through the bypass channel into the second pressure area, wherein the bypass channel and the device to open and close the bypass channel are designed so that, when the bypass channel is opened, deoiling in the bypass channel is brought about by at least one of flow diversion and impact separation in the bypass channel and not by means of a filter.

2. A device according to claim 1, wherein the device to open and close the bypass channel is a valve body charged by a pressure which, below a pre-specified opening pressure difference, is pressed into a closed position by the pressure spring against a valve seat, which is located in the bypass channel, wherein above the pre-specified opening pressure difference the valve body is raised from the valve seat against the pressure spring, thus releasing a flow gap.

3. A device according to claim 1, wherein the device to open and close the bypass channel is a valve body which, below a pre-specified opening pressure difference, is pressed into a closed position by gravity against the valve seat located in the bypass channel, wherein above the pre-specified opening pressure difference, the valve body is raised from the valve seat, thus releasing a flow gap.

4. A device according to claim 1, wherein the device to open and close the bypass channel is formed by a hinged throttle valve in the bypass channel.

5. A device according to claim 1, wherein the device to open and close the bypass channel is formed by a leaf valve.

6. A device according to claim 1, wherein the oil mist separator is in the form of a cyclone.

7. A device according to claim 1, wherein the oil mist separator is a coalescence separator in the form of a knitted or wrap-around separator.

8. A device according to claim 1, wherein the bypass channel is an integral component of the oil mist separator.

9. A device according to claim 6, wherein the bypass channel and the cyclone are made in one piece from synthetic material.

10. A device according to claim 9, wherein the gas outlets of the oil mist separator and of the bypass channel are led separately out of the crankcase in to the second pressure area.

11. A device according to claim 1, wherein a wall of the bypass channel surrounds the device and is spaced therefrom by a gap to allow the device to open and close.

12. A device according to claim 11, wherein the feedthrough cross section of the gap is maximally as big as the feedthrough cross section of the device.

13. A device according to claim 1, wherein the cross sectional surface of the bypass channel in front of the device is ⅓ to ⅛ of a face of the device acted upon by the gas from the first pressure area.

14. A device to deoil crankcase ventilation gases of an internal combustion engine with at least one oil mist separator, which has:

a gas inlet connected to a first pressure area and connected to a crankcase of the engine;

a gas outlet connected to a second pressure area and connected to an air intake section of the engine;

an oil outlet connected to an oil sump of the internal combustion engine;

wherein;

a bypass channel, which has a gas inlet connected to the first pressure area and a gas outlet connected to the second pressure area;

at least one device which, depending on a pressure difference between the two pressure areas, opens or closes the bypass channel one of continuously and gradually, to allow the crankcase ventilation gases to flow through;

wherein the device to open and close the bypass channel is a valve body charged by a pressure spring, which, below a pre-specified opening pressure difference, is pressed into a closed position by the pressure spring against a valve seat, which is located in the bypass channel, wherein above the pre-specified opening pressure difference the valve body is raised from the valve seat against the pressure spring, thus releasing a flow gap;

when the bypass channel is open, a partial volumetric flow of the crankcase ventilation gas flows past the oil mist separator through the bypass channel into the second pressure area, wherein the bypass channel and the device to open and close the bypass channel are designed so that, when the bypass channel is opened, deoiling is brought about by at least one of flow diversion and impact separation in the bypass channel; and wherein the overall length of the pressure spring can be adjusted in the differential pressureless state.

15. A device to deoil crankcase ventilation gases of an internal combustion engine with at least one oil mist separator, which has:

a gas inlet connected to a first pressure area and connected to a crankcase of the engine;

a gas outlet connected to a second pressure area and connected to an air intake section of the engine;

an oil outlet connected to an oil sump of the internal combustion engine;

wherein;

a bypass channel, which has a gas inlet connected to the first pressure area and a gas outlet connected to the second pressure area;

at least one device which, depending on a pressure difference between the two pressure areas, opens or closes the bypass channel one of continuously and gradually, to allow the crankcase ventilation gases to flow through;

wherein the device to open and close the bypass channel is a valve body charged by a pressure spring, which, below a pre-specified opening pressure difference, is pressed into a closed position by the pressure spring against a valve seat, which is located in the bypass channel, wherein above the pre-specified opening pressure difference the valve body is raised from the valve seat against the pressure spring, thus releasing a flow gap;

when the bypass channel is open, a partial volumetric flow of the crankcase ventilation gas flows past the oil mist separator through the bypass channel into the second pressure area, wherein the bypass channel and the device to open and close the bypass channel are designed so that, when the bypass channel is opened, deoiling is brought about by at least one of flow diversion and impact separation in the bypass channel; and wherein the end of the pressure spring that is turned away from the valve body is supported on a support element in the bypass channel, wherein the axial distance of the support element from the valve seat can be adjusted.

16. A device to deoil crankcase ventilation gases of an internal combustion engine with at least one oil mist separator, which has:

a gas inlet connected to a first pressure area and connected to a crankcase of the engine;

a gas outlet connected to a second pressure area and connected to an air intake section of the engine;

an oil outlet connected to an oil sump of the internal combustion engine;

wherein;

a bypass channel, which has a gas inlet connected to the first pressure area and a gas outlet connected to the second pressure area;

at least one device which, depending on a pressure difference between the two pressure areas, opens or closes the bypass channel one of continuously and gradually, to allow the crankcase ventilation gases to flow through;

wherein the device to open and close the bypass channel is a valve body charged by a pressure spring, which, below a pre-specified opening pressure difference, is pressed into a closed position by the pressure spring against a valve seat, which is located in the bypass channel, wherein above the pre-specified opening pressure difference the valve body is raised from the valve seat against the pressure spring, thus releasing a flow gap;

when the bypass channel is open, a partial volumetric flow of the crankcase ventilation gas flows past the oil mist separator through the bypass channel into the second pressure area, wherein the bypass channel and the device to open and close the bypass channel are designed so that, when the bypass channel is opened, deoiling is brought about by at least one of flow diversion and impact separation in the bypass channel; and wherein there is a lift limiter stop which determines the maximum amount by which determines the maximum amount by which the valve body can be raised from the valve seat.

17. A device to deoil crankcase ventilation gases of an internal combustion engine with at least one oil mist separator, which has:

a gas inlet connected to a first pressure area and connected to a crankcase of the engine;

a gas outlet connected to a second pressure area and connected to an air intake section of the engine;

an oil outlet connected to an oil sump of the internal combustion engine;

where;

a bypass channel, which has a gas inlet connected to the first pressure area and a gas outlet connected to the second pressure area;

wherein the bypass channel is an integral component of the oil mist separator;

at least one device which, depending on a pressure difference between the two pressure areas, opens or closes the bypass channel one of continuously and gradually, to allow the crankcase ventilation gases to flow through;

when the bypass channel is open, a partial volumetric flow of the crankcase ventilation gas flows past the oil mist separator through the bypass channel into the second pressure area, wherein the bypass channel and the device to open and close the bypass channel are designed so that, when the bypass channel is opened, deoiling is brought about by at least one of flow diversion and impact separation in the bypass channel; wherein the oil mist separator and the bypass channel are located, together with their respective gas inlets, in a common reception case, which is connected to the first pressure area, wherein the gas outlets of the oil mist separator and of the bypass channel are sealed against the pressure area inside the reception case, out of which they are led into the second pressure area.

18. A device according to claim 17, wherein the as outlet of the oil mist separator and of the bypass channel are led into a sealed intermediate space, which is connected to the second pressure area.

19. A device to deoil crankcase ventilation gases of an internal combustion engine with at least one oil mist separator, which has:

a gas inlet connected to a first pressure area and connected to a crankcase of the engine;

a gas outlet connected to a second pressure area and connected to an air intake section of the engine;

an oil outlet connected to an oil sump of the internal combustion engine;

where;

a bypass channel, which has a gas inlet connected to the first pressure area and a gas outlet connected to the second pressure area;

at least one device which, depending on a pressure difference between the two pressure areas, opens or closes the bypass channel one of continuously and gradually, to allow the crankcase ventilation gases to flow through;

when the bypass channel is open, a partial volumetric flow of the crankcase ventilation gas flows past the oil mist separator through the bypass channel into the second pressure area, wherein the bypass channel and the device to open and close the bypass channel are designed so that, when the bypass channel is opened, deoiling is brought about by at least one of flow diversion and impact separation in the bypass channel; wherein the bypass channel is directly or indirectly connected to the oil sump via an oil outlet.

20. A device to deoil crankcase ventilation gases of an internal combustion engine with at least one oil mist separator, which has:

a gas inlet connected to a first pressure area and connected to a crankcase of the engine;

a gas outlet connected to a second pressure area and connected to an air intake section of the engine;

an oil outlet connected to an oil sump of the internal combustion engine;

where;

a bypass channel, which has a gas inlet connected to the first pressure area and a gas outlet connected to the second pressure area;

at least one device which, depending on a pressure difference between the two pressure areas, opens or closes the bypass channel one of continuously and gradually, to allow the crankcase ventilation gases to flow through;

when the bypass channel is open, a partial volumetric flow of the crankcase ventilation gas flows past the oil mist separator through the bypass channel into the second pressure area, wherein the bypass channel and the device to open and close the bypass channel are designed so that, when the bypass channel is opened, deoiling is brought about by at least one of flow diversion and impact separation in the bypass channel; wherein there is an sensor, which detects whether the bypass channel is open, and which generates an optical or acoustical warning signal when the bypass channel is open.

* * * * *